US006274202B1

(12) United States Patent
Campbell

(10) Patent No.: US 6,274,202 B1
(45) Date of Patent: Aug. 14, 2001

(54) CONTROL SYSTEMS FOR ELECTROSTATIC POWDER SPRAYING APPARATUS

(75) Inventor: David Hugh Campbell, Southport (GB)

(73) Assignee: Eurotec Surface Coating Systems, Ltd., Wigan (GB)

( * ) Notice: Subject to any disclaimer, the term of this patent is extended or adjusted under 35 U.S.C. 154(b) by 0 days.

(21) Appl. No.: 09/284,259

(22) PCT Filed: Sep. 15, 1997

(86) PCT No.: PCT/GB97/02482

§ 371 Date: Oct. 1, 1999

§ 102(e) Date: Oct. 1, 1999

(87) PCT Pub. No.: WO98/10871

PCT Pub. Date: Mar. 19, 1998

(30) Foreign Application Priority Data

Sep. 13, 1996 (GB) ..... 9619178
Oct. 5, 1996 (GB) ..... 9620811

(51) Int. Cl.[7] ..... B05D 1/04; B05B 5/025

(52) U.S. Cl. ..... 427/475; 427/480; 118/629; 118/631; 118/671

(58) Field of Search ..... 427/475–486; 118/671, 627, 629, 631; 239/3, 101, 690, 708

(56) References Cited

U.S. PATENT DOCUMENTS 3,875,892 4/1975 Gregg et al. ..... 118/4
4,000,443 12/1976 Lever ..... 317/3
4,485,427 11/1984 Woodruff ..... 361/235
5,138,513 8/1992 Weinstein ..... 361/2
5,741,558 * 4/1998 Otani et al. .

FOREIGN PATENT DOCUMENTS 32 15 644 10/1983 (DE) .
59 474 8/1947 (GB) .
1 478 303 6/1978 (GB) .
2 132 832 7/1984 (GB) .

OTHER PUBLICATIONS

Patent Abstracts of Japan, vol. 017, No. 321 (C–1072) Jun. 18, 1993 and JP 05031408A, Trinity Ind. Corp., Feb. 9, 1993, (abstract).

Patent Abstracts of Japan, vol. 007, No. 066 (C–157) Mar. 8, 1983 and JP 58000271A, (Origin Denki KK). Jan. 5, 1983, (abstract).

Patent Abstracts of Japan, vol. 095, No. 011, Dec. 26, 1995 and JP 07 213955A, (Asahi Sanac KK), (abstract).

* cited by examiner

*Primary Examiner*—Fred J. Parker
(74) *Attorney, Agent, or Firm*—Olson & Hierl, Ltd.

(57) ABSTRACT

A method for controlling operation of powder spraying coating apparatus comprising automatically reducing both the discharge current and discharge voltage of the electrostatic charging means as the spray apparatus approaches a workpiece.

21 Claims, 6 Drawing Sheets

TOTAL ENERGY CONTROL

VOLTAGE CONTROL

CURRENT CONTROL

TOTAL ENERGY CONTROL

CONTROL SYSTEMS FOR ELECTROSTATIC POWDER SPRAYING APPARATUS

FIELD OF THE INVENTION

This invention concerns control systems for electrostatic powder spraying apparatus.

BACKGROUND OF THE INVENTION

Electrostatic spraying apparatus, especially for use in painting workpieces, generally comprise a duct for conveying gas-borne powder and means for electrostatically charging the powder, whereby it adheres to the workpiece. Typically a corona discharge needle electrode is used to charge the powder.

Corona charging of paint powder is not without its shortcomings although it is a preferred method of spray coating for a majority of powder coaters. Problems associated with Faraday Cages, back ionisation orange peel (pitting) and overcharging have been well documented but advantages of consistency, good charge transfer and fast powder deposition largely outweigh the above-mentioned shortcomings.

The effects of such shortcomings may be reduced by spray nozzle design or by addition of earth robbing electrodes behind the spray nozzle, as well as by careful setting of the spray apparatus position and operating parameters.

Significant improvements can also be achieved by controlling the discharge current instead of the discharge voltage which has proved its worth over 25 years but surprisingly this method is still the exception rather than the rule. With this system the maximum discharge current ($\mu$A) is limited to a value determined by the operator and the discharge voltage (kV) is allowed to float. The result is that as the spray apparatus approaches the workpiece and the set discharge current is reached and stabilises, so the output voltage automatically reduces to relatively low levels, thus limiting the charge when the apparatus is close to the workpiece. This is of great benefit in maintaining charge consistency, penetrating Faraday Cages and reducing back ionisation and orange peel appearance.

With conventional voltage control, where the discharge voltage is set by the operator, the current rises exponentially as the spray apparatus approaches the product which has the opposite effect to that of using current control and can also cause severe "over charging" of the powder and surrounding air and can give rise to potentially dangerous sparks, although safety cut out circuits are usually employed.

Despite the many advantages of current controlled corona charging, it is still not perfect because the output voltage is allowed to float, when the spray apparatus is pulled away from the workpiece the current can fall below its "constant" or controlled setting and the voltage can rise to the maximum available from the generator, usually 80+kV. In some cases this may be too high and create strong field lines, with the resulting Faraday Cage difficulties. As the gun approaches the product, the air space between the gun and the product obviously reduces and will therefore accept a progressively smaller charge from the corona needle in terms of free ions. It is the free ions which charge the air molecules and then transfer the charge to the powder. The closer the spray apparatus is to the workpiece so the greater the proportion of free ions which are attracted to the surface of the workpiece as opposed to dissipating in the surrounding air, or being neutralised by metal walls of the spray booth. This high charge on the surface of the powder is the main cause of the orange peel effect.

An aim of a first aspect of the present invention is to provide an improved method of controlling operation of powder spray coating apparatus whereby the above-mentioned shortcomings of prior art methods may be overcome or at least reduced in effect.

In conventional electrostatic spraying apparatus, the flow of powder from a container to the means for electrostatically charging the powder is controlled by compressed air. As the spray apparatus approaches a workpiece, the surface area which is sprayed reduces and hence the volume of powder paint required also reduces. In practice, as the spray apparatus approaches the workpiece, an operator will manually reduce the volume of powder flowing to the electrostatic charging means by, for example, reducing the pressure of the compressed air. However, since the volume of powder sprayed is controlled manually, this can lead to irreproducible coating results.

An aim of a second aspect of the present invention is to provide an electrostatic spraying apparatus which overcomes the afore-mentioned problem.

SUMMARY OF THE INVENTION

According to a first aspect of the invention there is provided a method for controlling operation of powder spray coating apparatus in order to improve coating, comprising controlling the output power charging the powder by progressively reducing both the discharge current and discharge voltage as the spray apparatus approaches a workpiece wherein said reduction in the discharge current and discharge voltage commences at a distance of separation between the spray apparatus and workpiece which is at least 100 mm.

Preferably, the powder spray coating apparatus comprises means for automatically reducing the discharged current and discharge voltage as the spray apparatus approaches the workpiece. In a preferred embodiment of the invention, the reduction in the discharge current and discharge voltage is reversible as the spray apparatus moves away from the workpiece. It is preferred that said means for automatically reducing the discharge current and discharge voltage also, automatically, increases the discharge current and discharge voltage as the spray apparatus moves away from the workpiece.

Preferably the discharge current can be set not to exceed an upper limit typically of 50 $\mu$A but possibly alternatively of, say, 30 $\mu$A. It is preferred that, in use, said means for reducing the discharge current and hence the output power comes into operation when the discharge current reaches said pre-set upper limit, ie the threshold discharge current. Similarly, said means for increasing the discharge current when the spray apparatus moves away from the workpiece may stop its operation when said discharge current reaches its pre-set upper limit.

Preferably, the maximum discharge voltage may be set by the apparatus operator, which in turn also controls the normal operating level of the discharge current.

In accordance with a further embodiment of the invention, the powder spray coating apparatus may further comprise means for reducing the volume of powder dispensed by the spray apparatus as the spray apparatus approaches the workpiece. Said reduction in the volume of paint may be in response to a decrease in the output power.

According to a second aspect of the present invention there is provided an electrostatic powder spray coating apparatus comprising an electrostatic charging means and means for controlling the volume of paint sprayed in response to a change in discharge current or discharge voltage of the electrostatic charging means.

As discussed above, with conventional electrostatic spray apparatus where the discharge current is controlled, as the spray approaches a workpiece the discharge voltage reduces. This effect is also observed where the discharge voltage is controlled. Hence, the present invention provides a system whereby the volume of paint sprayed automatically reduces as the spray apparatus approaches the workpiece and therefore reproducible coating results can be obtained. Similarly, as the spray apparatus is moved away from the workpiece, the discharge voltage increases and therefore the volume of paint sprayed will also increase correspondingly.

It is preferred that said control means reduces the volume of paint sprayed in response, to a reduction in the discharge voltage and, conversely, increases the volume in response to an increase in the discharge voltage. The control means is preferably dependent upon the actual value of the discharge voltage. Therefore, at predetermined minimum and maximum values of discharge voltage, the control means may allow, respectively, a minimum and maximum volume of paint to be sprayed Preferably, volume of paint flowing to the electrostatic charging means is controlled such that it is proportional to the discharge voltage.

Compressed air is utilised to convey powder to the electrostatic charging means and hence the flow rate of the paint is dependent upon the pressure of the air and its flow rate. Hence, the volume of paint conveyed to the electrostatic charging means is also dependent upon these two factors. The control means may control the air pressure thereby controlling the flow rate of the paint and, as a result, the volume of paint flowing to the electrostatic charging means. Alternatively, the flow rate of the compressed air may be controlled by varying the size of an orifice through which the air passes.

The volume of paint flowing to the electrostatic charging means may also be controlled by varying the size of an orifice through which the powder may flow. The control means may control the size of said orifice.

Said control means may comprise a regulator which controls the pressure of the air pressure such that said pressure is proportional to the discharge voltage. The control means may comprise a proportional control valve.

In an alternative embodiment, the delivery of powder from a container to the compressed air means is controlled by said control means thereby controlling the volume of powder conveyed to the electrostatic charging means.

There are many known methods of delivering powder to said compressed air means, e.g. by use of a vibrational hopper feeder or a screw feeder device. In the case of a vibrational hopper feeder, the frequency of vibration may be controlled in order to vary the volume of powder delivered. If a screw feeder device is utilised then the speed of rotation of the screw may be controlled in order to vary the volume of powder delivered to the compressed air means in response to a change in the discharge voltage.

Said delivery of the powder may, conceivably, be by way of a conveyor belt and the speed of the belt may be controlled so as to vary the volume of powder delivered.

BRIEF DESCRIPTION OF THE DRAWINGS

This invention will now be further described, by way of example only, with reference to the accompanying drawings, in which.

DETAILED DESCRIPTION OF PREFERRED EMBODIMENTS

Figure 1:
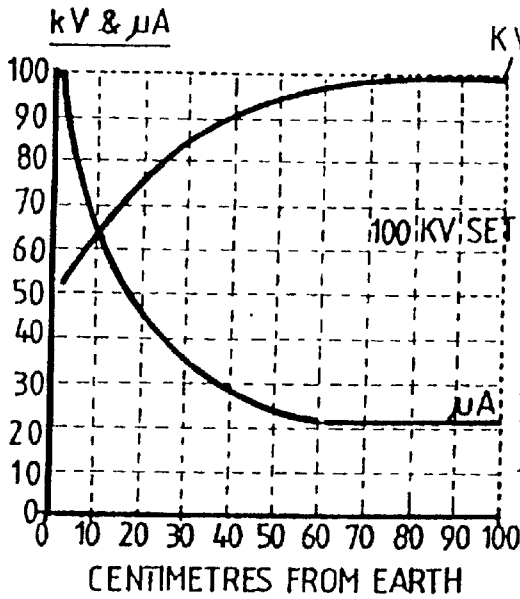
FIGS. 1 to 3 are respectively graphs illustrating voltage control only, current control only and combined voltage and current control according to the invention.

Referring to FIG. 1 of the accompanying drawings, a graph is shown of voltage against distance and current against distance when the discharge voltage only is controlled in operating of a powder spray gun. The voltage level decreases as the gun nears the workpiece due to the characteristics of the voltage regulator. Unfortunately with no control over the current, this rises exponentially as the gun nears the workpiece. This can result in overcharging of the powder and surrounding air and give rise to dangerous sparks.

Figure 2:
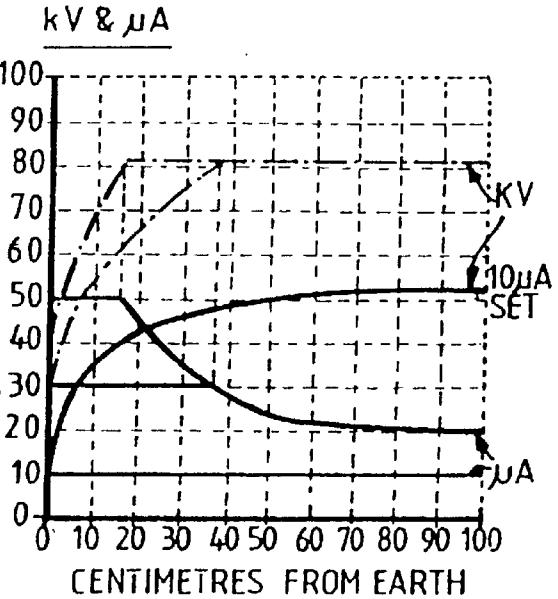

FIG. 2 illustrates the prior art alternative which is to control the discharge current. This has two problems that are shown by the graph, which again plots voltage against distance and current against distance but for three different current levels namely 50, 30 and 10 $\mu$A. The first problem is that as the gun is moved away from the workpiece and the current falls below its controlled setting, the discharge voltage rises up to the maximum available from the high voltage generator. This can be too high a voltage causing strong field lines and resulting in Faraday Cage difficulties.

The second problem is that as the gun approaches the workpiece the air space between becomes smaller, so that more of the free air ions that are produced are attracted to the workpiece and cause the "orange peel" effect on the workpiece surface.

Figure 3:
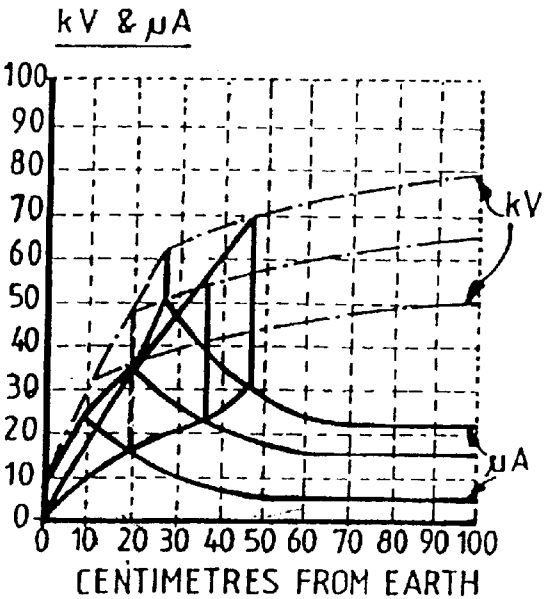

The system according to the present invention of controlling both the discharge voltage and discharge current is illustrated in FIG. 3. As can be seen the discharge current has a maximum value set, eg. 50 $\mu$A or 30 $\mu$A, but as the gun approaches the workpiece, the current is brought down to avoid the problem of excess air ions causing "orange peel" effect on the workpiece surface. At the same time the discharge voltage is brought down which helps to overcome Faraday Cage problems.

When the gun is moved away from the workpiece the discharge current rises to its threshold then falls off but the voltage may be controlled by the operator so as to remain below the maximum available from the high voltage generator.

Figure 4:
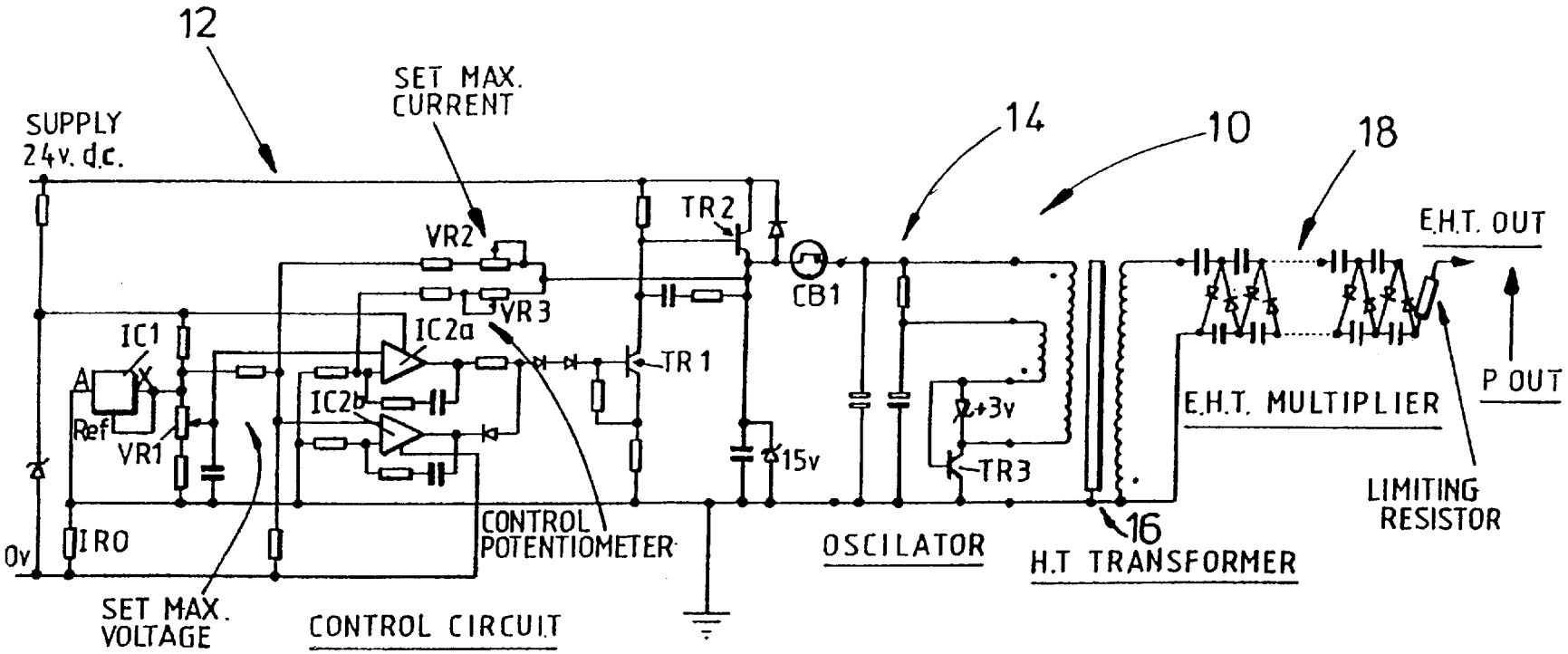
FIG. 4 is a circuit diagram for providing combined voltage and current control for a powder spray coating gun of the invention.

FIG. 4 of the accompanying drawings shows a control circuit for achieving control of current and voltage as illustrated in FIG. 3.

Figure 5:
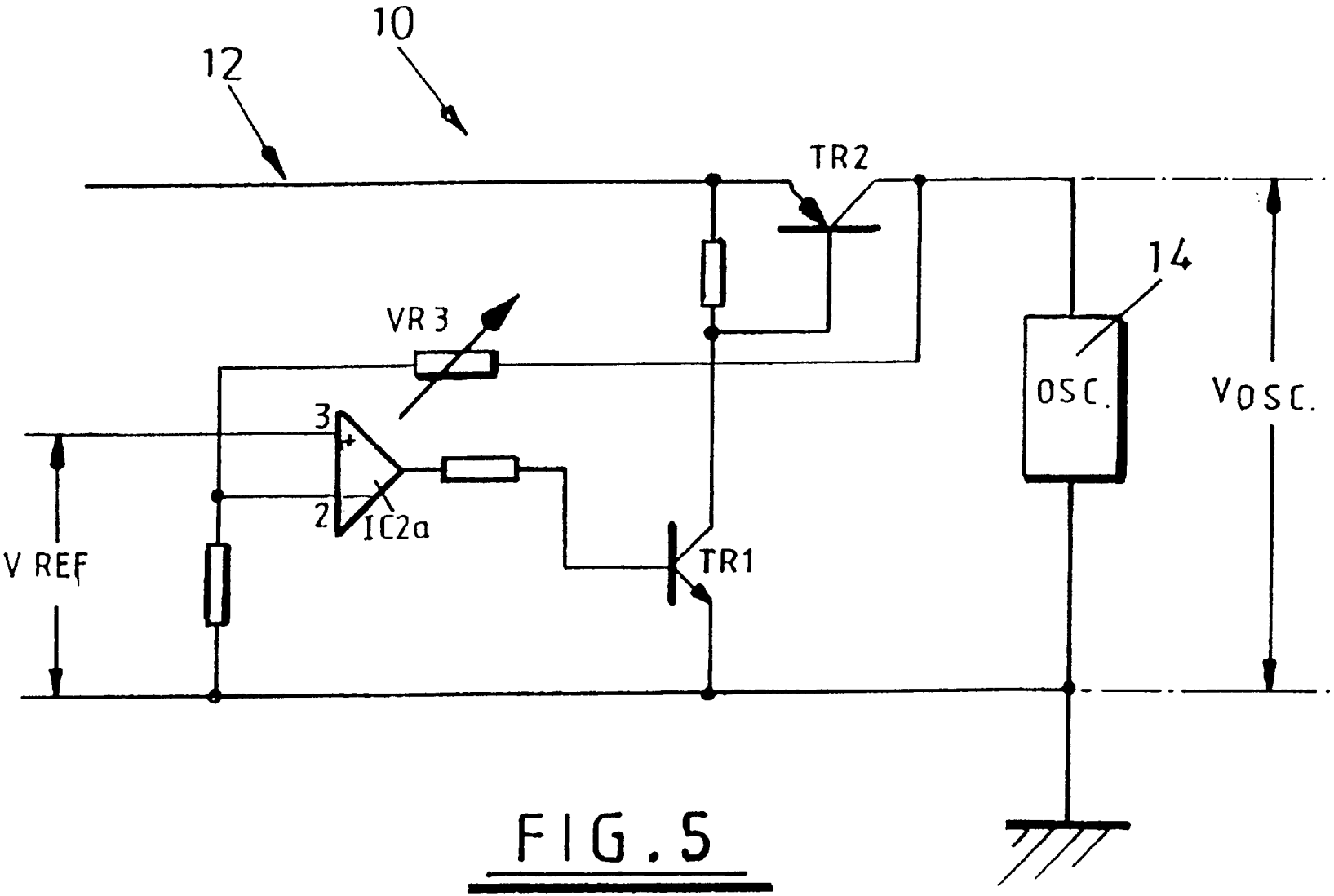
FIGS. 5 and 6 are simplified circuit diagrams of different aspects of the circuit shown in FIG. 4.
Figure 6:
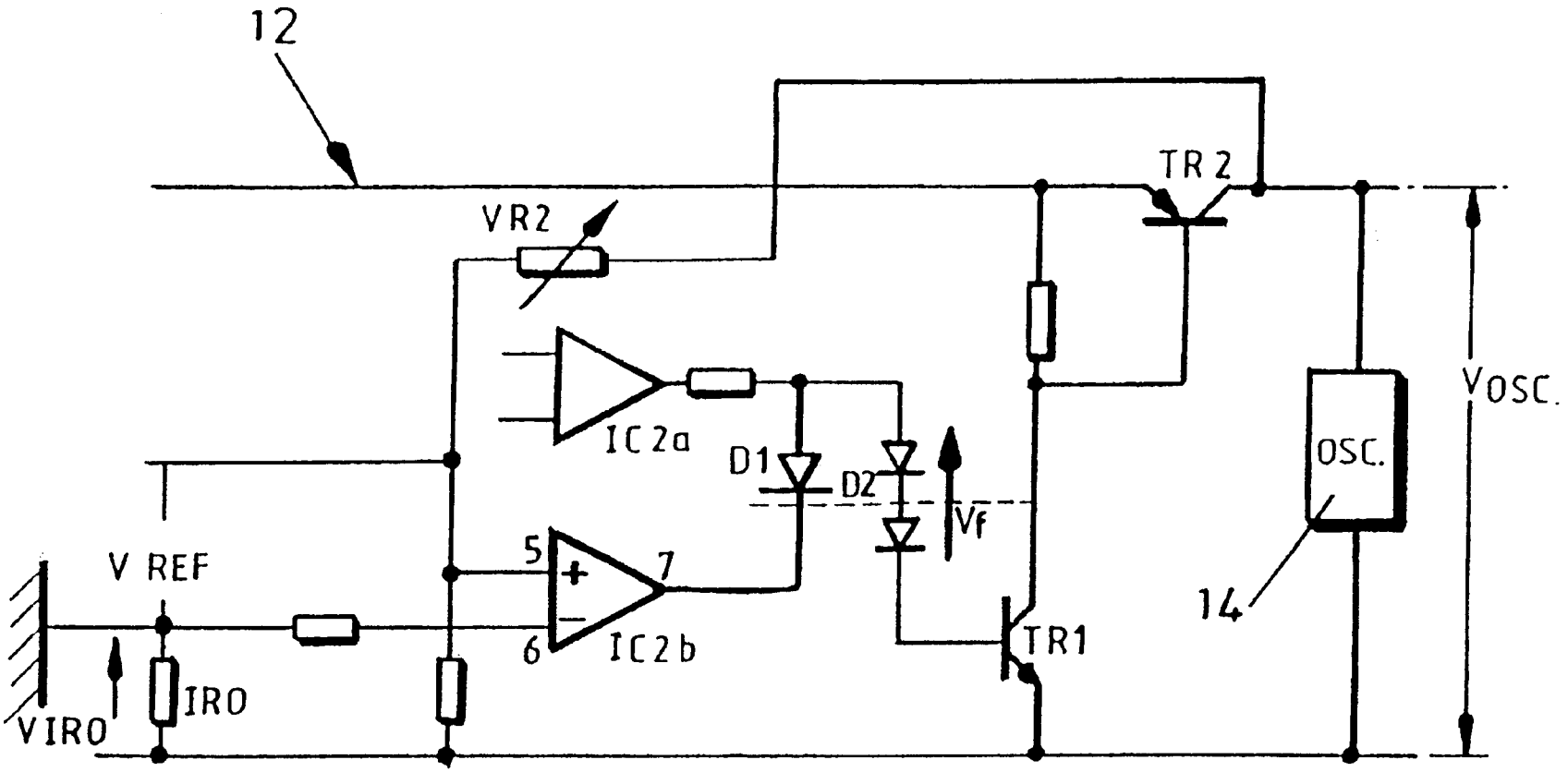

With reference to FIGS. 4, 5 and 6, the circuit is indicated generally by numeral 10 and comprises a 24 V d.c. supply 12, a reference voltage IC1, a dual operational amplifier comprising a first and second Op-amp IC2*a* and IC2*b*, a first transistor TR1, a second transistor TR2, a power resistor IRO, potentiometers VR1, VR2 and VR3, an oscillator 14, H.T. transformer 16 and an E.H.T. multiplier 18.

The voltage Vosc across oscillator 14 is dependent upon, the conducting state of transistor TR2 which is itself dependent upon the voltage across potentiometer VR3 for reasons which will become apparent hereinafter.

The input to the non-inverting terminal 3 of Op-amp IC2*a* is set at a reference voltage V ref which is generated by voltage reference IC1 and potentiometer VR1. The input to the inverting terminal 2 of the Op-amp is set by potentiometer VR3.

The non-inverting terminal 5 of Op-amp IC2*b* is held at a voltage which is set by potentiometer VR2 and the reference voltage IC1. The input to the inverting terminal 6 is dependent upon the voltage across resistor IRO.

Assuming that the 24 V supply voltage is reasonably constant and that the efficiency of the DC-DC conversion of the circuit is also approximately constant then the output power P out of the EHT multiplier 18 will be proportional to the input power as determined by the voltage across the oscillator and the current flowing therethrough. The current through resistor IRO is that through oscillator 14 and therefore the voltage V IRO across resistor IRO is also proportional to P out. Diode D1 only conducts when the voltage Vf across diodes D2 plus voltage Vbe of transistor TR1 is greater than the output voltage of IC2*b*.

The operation of the circuit will now be described with, initially, the spray apparatus spaced from the workpiece at, say, 100 cm. If voltage Vosc increases then the voltage at terminal 2 of IC2*a* also increases. As a result, the output voltage of Op-amp IC2*a* decreases and the base current of TR1 is reduced thereby decreasing the current flowing through TR1. This has the effect of reducing the base-emitter voltage VBE2 of transistor TR2 which increases voltage VEC2 of the transistor and hence voltage Vosc is decreased i.e. voltage Vosc falls to compensate for the initial rise. If voltage Vosc falls then the opposite changes to the above occur and hence voltage VEC of TR2 decreases and therefore voltage Vosc rises. Hence, in the above described manner, the circuit as shown in FIG. 5 maintains the oscillator voltage Vosc at a constant value ie. the output power is held constant, when the spray apparatus is at a given distance from the workpiece.

From the above it will be seen that the voltages at terminals 2 and 3 of Op-amp IC2*a* dictate the value of voltage Vosc and consequently the output power P out of EHT multiplier. Hence, potentiometers VR1 and VR3 control the maximum output power P out.

As the spray apparatus approaches the workpiece, the output power P out of the EHT multiplier increases. As mentioned above, the voltage V IRO across resistor IRO is proportional to the output power and therefore this voltage also increases with increasing P out. The increase of voltage at terminal 6 of Op-amp IC2*b* results in a reduction in the output voltage of the Op-amp.

Consequently, as the spray apparatus continues to approach the workpiece, the output voltage of Op-amp IC2*b* decreases and a point is reached when this voltage is less than Vf+Vbe1 ie diode D1 begins to conduct. The output voltage of IC2*b* is, of course, dependent upon the two inputs on terminals 5 and 6. Initially, potentiometer VR2 is varied such that the value of the output voltage of Op-amp IC2*b* is less than Vf+Vbe1 when a predetermined output power or discharge power is reached. Therefore, the discharge current at which the output voltage of Op-amp IC2*b* is less than said voltage Vf+Vbe1 ie the threshold current, can be set at any given value and may, for example, be set at 30 $\mu$A or 50 $\mu$A. In this manner the discharge current at which the circuit begins to reduce the discharge power P out can be pre-set.

When D1 conducts, a part of the current flowing into the base of TR1 starts to flow through D1 and therefore TR1 conducts less. Hence, VEC of TR2 increases and therefore Vosc decreases. The reduction in Vosc results in a lowering in the voltage at terminal 5 which causes a further decrease in the output voltage of Op-amp lC2*b*.

This has the effect of drawing more current through D1 which reduces the current flowing into the base of TR1 and therefore further reducing voltage Vosc and hence P out, ie. positive feedback occurs. In this manner, Vosc reduces and P out. falls correspondingly.

Although the circuitry of FIG. 5 attempts to counter the change in the value of Vosc by increasing the output of IC2*a*, since D1 is conducting the increase in the current is not all directed to the base of TR1 and the net effect is a reduction in the base current.

Since output power P out decreases, voltage V IRO also decreases and the circuit stabilises at a lower level of output power.

The circuit provides a system whereby the discharge power decreases as the spray apparatus is brought close to the workpiece and therefore avoids the problems experienced with existing spray apparatus.

If the spray apparatus is moved away from the workpiece, P out increases and the reverse of the above described changes occur. Hence, the discharge current and voltage characteristics of the spray apparatus as it is moved towards and away from the workpiece are identical, i.e the discharge current and voltage characteristics are reversible.

In a further embodiment of the invention (not shown), circuit 10 comprises a proportional control valve, otherwise known as an electronic pneumatic regulator or an E-P converter, which controls the volume of powder sprayed by the gun in response to a decrease or increase in the discharge voltage. The powder is caused to flow to the discharge nozzle of the spray apparatus by compressed air and said proportional control valve may control the pressure of the compressed air. Hence, as the gun approaches the workpiece, the proportional control valve automatically reduces the volume of powder being charged. Since V osc is proportional to the discharge voltage and consequently the discharge power, the proportional control valve conveniently acts upon a change in V osc.

Figure 7:
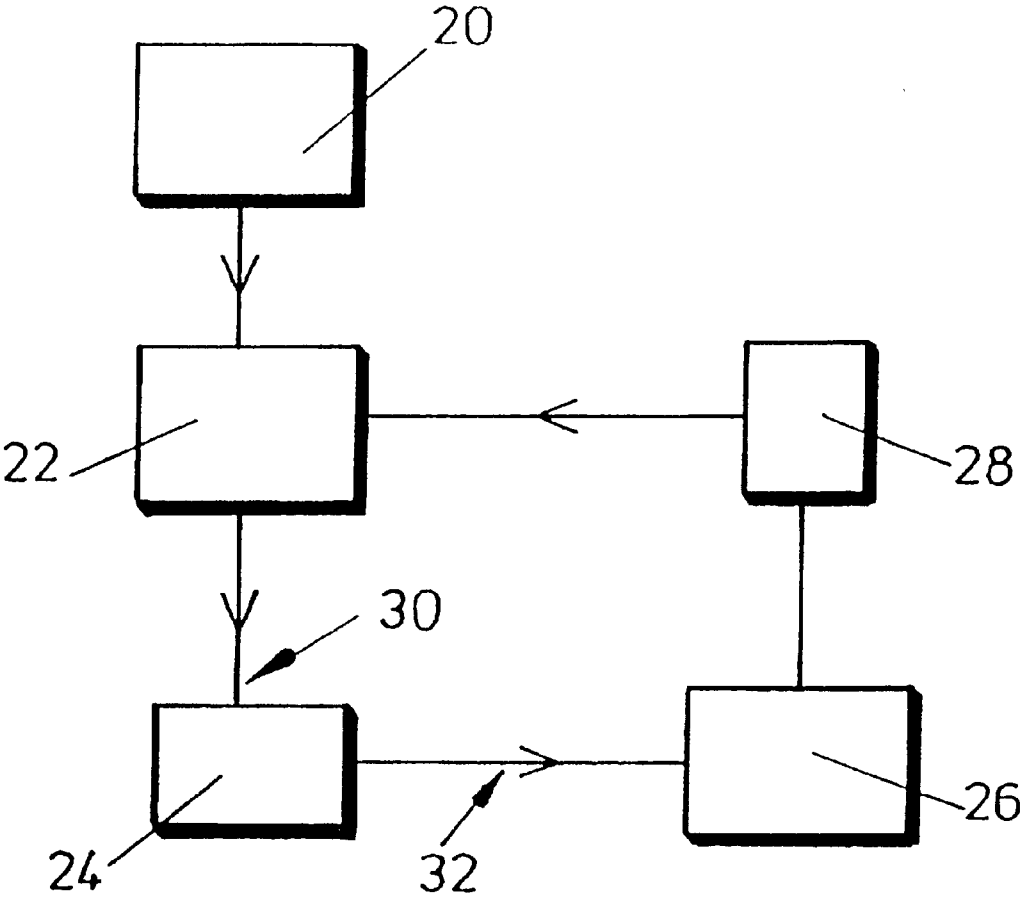
FIG. 7 is a block diagram of an embodiment of the present invention according to a second aspect.

With reference to FIG. 7, a further embodiment of the invention will now be described. The electrostatic powder spray coating apparatus comprises a hopper 20 containing powder paint, a volumetric screw feeder device 22, a compressed air venturi 24, a spray gun and control circuitry 26 e.g. see circuitry described above with reference to FIG. 4, and control means 28.

The compressed air venturi has the ability to suck powder from the screw feeder device 22 via tube 30 and blow the powder to the spray gun through hose 32. The volume of powder delivered to venturi 24 is dependent upon the rotational speed of the screw which is controlled by control means 28. The control means 28 monitors the discharge voltage of the gun and controls the speed of the screw accordingly.

The operation of the apparatus will now be described with, initially, the gun operating at its usual distance from a workpiece. With reference to FIGS. 1 to 3 it will be seen that as the gun approaches the workpiece, the discharge voltage decreases. The fall in discharge voltage is detected by the control means which acts to reduce the speed of rotation of the screw thereby reducing the volume of powder delivered to the venturi and consequently the volume of powder which is sprayed. As the gun continues to approach the workpiece the discharge voltage will continue to fall and so, accordingly, will the volume of powder delivered to the venturi. The reverse action occurs when the gun is pulled away from the workpiece, i.e. the discharge voltage increases and the volume of powder delivered also increases.

The above described embodiment simply describes one method of controlling the flow of powder to the electrostatic charging means but, in practice, the flow can be controlled in a number of ways. For example, the pressure and flow rate of the compressed air can be controlled so as to vary automatically the volume of powder flowing to the electrostatic charging means when the discharge voltage varies.

Figure 8:
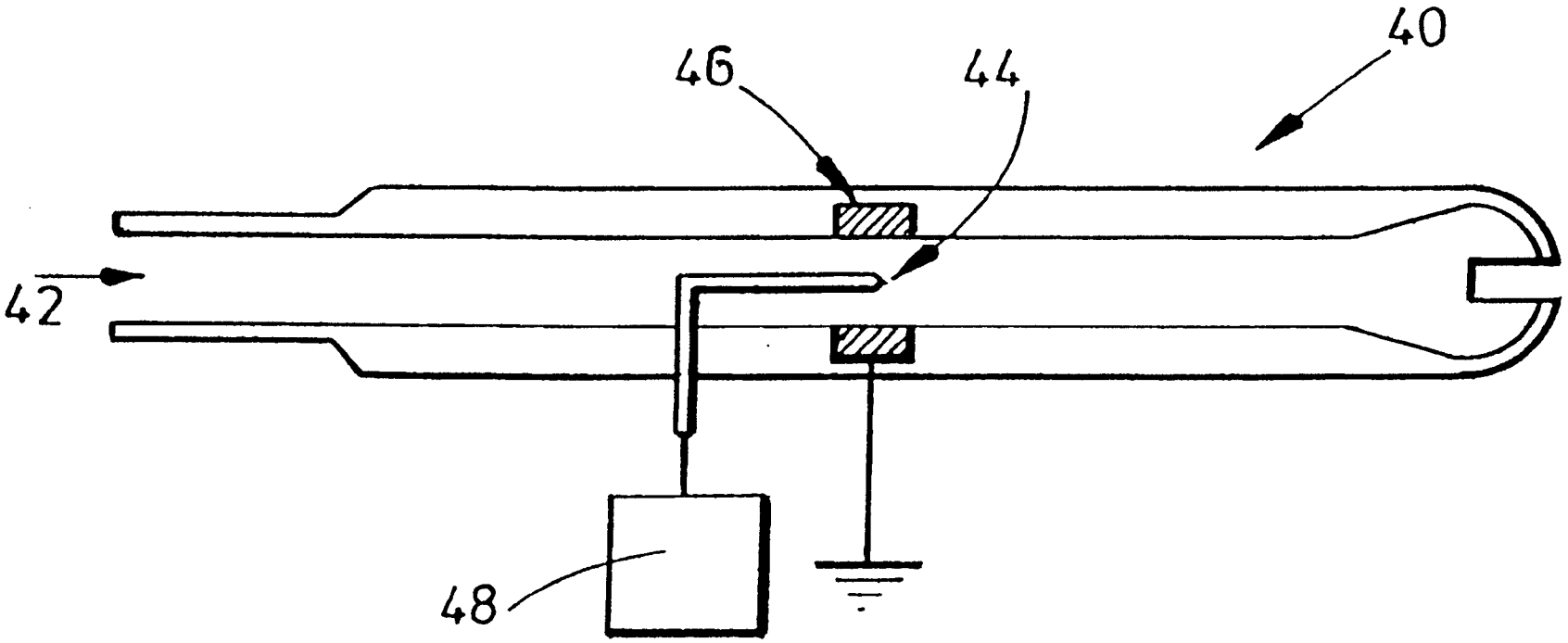
FIG. 8 is a schematic of an internal charging gun according to a further embodiment of the invention.

With reference to FIG. 8, a further embodiment of the present invention will now be described. An internal charging gun which forms part of an electrostatic powder spray coating apparatus is indicated generally by numeral 40. The internal charging gun comprises a duct 42 in which a corona discharge needle electrode 44 is located, an earth ring electrode 46 which surrounds the tip of the corona needle electrode and control circuit 48, illustrated in FIGS. 4, 5 and 6 and described above.

In use, gas borne powder is passed through duct 42 and electrostatically charged by the operation of the corona needle electrode at a predetermined charge. During the operation of the gun, it is usual for conditions to change. A typical example of this is an increase in the density of the powder flowing through the duct. In such circumstances, the resistance between the earth ring electrode and the corona needle electrode will increase and, in the manner described above, the discharge current and discharge voltage will increase to compensate thereby maintaining optimum charging energy. It will be appreciated that an increase in resistance between the earth ring electrode and the corona needle electrode results in the same response by circuit 48 as when, in the above described embodiments, the gun moves away from a workpiece.

What is claimed is:

1. A method for controlling operation of a powder spray coating apparatus in order to improve powder coating, comprising controlling output power charging a powder by progressively reducing both a discharge current and a discharge voltage as the spray coating apparatus approaches a workpiece wherein said reduction in the discharge current and discharge voltage commences at a distance of separation between the spray coating apparatus and workpiece which is at least 100 mm to provide substantially reproducible coating results during operation of the powder spray coating apparatus.

2. A method as claimed in claim 1 wherein the reduction in the discharge current and discharge voltage is reversible as the spray coating apparatus moves away from the workpiece.

3. A method as claimed in claim 1 wherein the powder spray coating apparatus comprises means for automatically reducing said discharge current and discharge voltage as the spray coating apparatus approaches the workpiece.

4. A method as claimed in claim 3 wherein said means for automatically reducing the discharge current and discharge voltage also automatically increases the discharge current and discharge voltage as the spray apparatus moves away from the workpiece.

5. A method as claimed in claim 4 wherein the discharge current is limited so as not to exceed a maximum valve.

6. A method as claimed in claim 5 wherein said maximum limit is 50 $\mu$A.

7. A method as claimed in claim 5 wherein the upper limit is 30 $\mu$A.

8. A method as claimed in claim 5, wherein said means for reducing the discharge current and discharge voltage comes into operation when the discharge current reaches said maximum value.

9. A method as claimed in claim 5, wherein said means for increasing the discharge current and discharge voltage when the spray coating apparatus moves away from the workpiece ceases its operation when said discharge current reaches said maximum value.

10. A method as claimed in claim 1 wherein the powder spray coating apparatus further comprises means for reducing a volume of powder dispensed by the spray coating apparatus as the spray coating apparatus approaches the workpiece.

11. A method as claimed in claim 10 wherein a reduction in the volume of powder is in response to a decrease in the output power.

12. A method as claimed in claim 1, wherein a volume of powder sprayed is controlled by a change of discharge current or discharge voltage.

13. An electrostatic powder spray coating apparatus comprising an electrostatic charging means and means to control a volume of paint powder sprayed in response to a change in discharge current or discharge voltage of the electrostatic charging means.

14. An electrostatic powder spray coating apparatus as claimed in claim 13 wherein said control means reduces the volume of paint powder sprayed in response to a reduction in the discharge voltage and, conversely, increases the volume in response to an increase in the discharge voltage.

15. An electrostatic powder spray coating apparatus as claimed in claim 13 wherein the volume of paint powder sprayed is proportional to the value of the discharge voltage.

16. An electrostatic powder spray coating apparatus as claimed in claim 13, wherein compressed air is utilized to convey the paint powder to the electrostatic charging means and the control means controls the flow rate of the paint powder and thereby the volume of paint powder flowing to the electrostatic charging means.

17. An electrostatic powder spray coating apparatus as claimed in claim 16 wherein the control means controls said flow rate of paint powder by controlling the pressure of the air.

18. An electrostatic powder spray coating apparatus as claimed in claim 16 wherein the control means controls the flow rate by varying the size of an orifice through which the air passes.

19. An electrostatic powder spray coating apparatus as claimed in claim 16 wherein the control means controls the volume of paint powder flowing to the electrostatic charging means by varying the size of an orifice through which the paint powder flows.

20. An electrostatic powder spray coating apparatus as claimed in claim 16 wherein said control means comprises a regulator which controls the pressure of the air such that said pressure is proportional to the discharge voltage.

21. An electrostatic powder spray coating apparatus as claimed in claim 20 wherein the control means comprises a proportional control valve.

* * * * *